United States Patent [19]

DesChamps

[11] 4,314,607

[45] Feb. 9, 1982

[54] PLATE TYPE HEAT EXCHANGER

[75] Inventor: Nicholas H. DesChamps, Whippany, N.J.

[73] Assignee: DesChamps Laboratories, Inc., East Hanover, N.J.

[21] Appl. No.: 94,047

[22] Filed: Nov. 14, 1979

[51] Int. Cl.[3] ..... F28F 3/10

[52] U.S. Cl. ..... 165/166

[58] Field of Search ..... 165/69, 70, 157, 166, 165/167, 53, 55; 62/285

[56] References Cited

U.S. PATENT DOCUMENTS

| | | | |
|---|---|---|---|
| 1,548,159 | 8/1925 | Murray | 165/166 |
| 2,927,781 | 3/1960 | Fohrhaltz et al. | 165/69 |
| 3,552,488 | 1/1971 | Grill | 165/166 |
| 3,678,993 | 7/1972 | Pierce | 62/285 X |
| 3,734,177 | 5/1973 | Bellovary et al. | 165/166 |
| 3,923,098 | 12/1975 | Ares | 62/285 X |

*Primary Examiner*—Samuel Scott
*Assistant Examiner*—Theophil W. Streule
*Attorney, Agent, or Firm*—Steinberg & Raskin

[57] ABSTRACT

A plate type heat exchanger of the continuous plate type includes a housing having opposed open ends and a thermal transfer core disposed within the housing which is formed of a continuous sheet of heat conductive material folded upon itself on fold regions in opposite directions alternately to define a plurality of substantially parallel, mutually spaced sheet portions which extend through the housing, substantially each sheet portion thereby being located between first and second adjacent sheet portions with the fold regions being located contiguous with opposed sides of the housing. Each sheet portion has a pair of free edge sections located in the regions of the respective open ends of the housing, portions of which are sealed together in a certain manner to define a first set of fluid flow channels for a warm fluid, each of the first channels having first and second fluid transmitting openings located at the respective open ends of the housing and a second set of fluid flow channels for a cool fluid, each of the second channels having third and fourth fluid transmitting openings also located at the respective open ends of the housing.

15 Claims, 13 Drawing Figures

PLATE TYPE HEAT EXCHANGER

BACKGROUND OF THE INVENTION

This invention relates, generally to heat exchangers and, more particularly to heat exchangers of the plate-type, i.e., wherein thermal energy is transferred between two currents of moving fluid through a plate formed of heat conductive material.

Although in the following description reference will be made to air-to-air heat exchangers wherein thermal energy is transferred from a warm air current to a cooler one, it is understood that the invention is applicable to heat transfer between a pair of any fluids. The present invention has its greatest applicability in the area of air-to-air heat exchangers which are intended to recover energy from a waste or stale air steam and transfer it to an incoming stream of fresh air.

There are presently available many types of air-to-air heat exchangers which function to recover thermal energy from stale or waste air and transfer it to incoming fresh or make-up air. For example, heat exchangers of the rotating wheel regenerative type, the heat pipe type, the run-around coil loop type, the shell-and-tube type and the plate-type are all known and each such type of heat exchanger has certain peculiar characteristics which tend to make it more readily adaptable to a particular application than the other devices. Of all these types of heat exchangers, the plate-type heat exchanger is generally acknowledged as being the most simple in construction as well as being one of the more efficient and easier to maintain types of heat exchangers. The present invention relates to such plate-type heat exchangers.

Plate-type heat exchangers can generally be divided into two categories. More particularly, a first category can be termed "discrete plate exchangers". Such discrete plate exchangers generally are formed of a plurality of adjacent individual sheets or plates formed of a heat conductive material and which extend generally parallel to each other between the open ends of housing so that a plurality of adjacent channels are defined between pairs of adjacent plates.

The second category of plate-type heat exchangers can be termed "continuous sheet exchangers" wherein the thermal transfer core is generally formed of a continuous sheet of heat conductive material which is folded upon itself in opposite directions alternately to define a plurality of spaced, parallel sheet portions. In this manner a plurality of channels are formed between pairs of adjacent sheet portions. Examples of such continuous sheet exchangers are disclosed in U.S. Pat. No. 2,576,213 to Chausson, No. 2,945,680 to Slemmons and No. 4,043,388 to Zebuhr.

Continuous sheet exchangers have several distinct advantages relative to discrete plate exchangers. More particularly, by forming the thermal transfer core of a single continuous sheet of heat conductive material, significant economies in manufacturing are achieved relative to discrete plate exchangers which, as mentioned above, require the manufacture of a plurality of separate plates. The continuous nature of the thermal transfer core in continuous sheet exchangers reduces the extent of sealing required in the manufacture of the heat exchanger. Further, it is possible in continuous sheet exchangers to achieve the proper spacing between adjacent pairs of sheet portions through the provision of appropriately formed spacing dimples in the continuous sheet. A particularly favorable arrangement of such spaced dimples is illustrated in the above-mentioned U.S. Pat. No. 4,043,388.

However, conventional plate-type heat exchangers of both the discrete and continuous type have certain disadvantages. Of perhaps the greatest significance, currently available discrete and continuous plate-type heat exchangers require relatively complicated manifolding arrangements whereby alternate pairs of adjacent plates in discrete plate exchangers or sheet portions in continuous sheet exchangers define a first set of fluid flow channels for warm air while the other alternate pairs of adjacent plates or sheet portions define a second set of fluid flow channels for cool air. Relatively extensive sealing arrangements are required to accomplish this in conventional plate-type heat exchangers, which sealing not only adds to the cost of manufacture of the heat exchangers but, additionally, adds significantly to the weight and bulk of the apparatus. Such sealing frequently includes embedding the edges of the plates or sheet portions in a thermosetting resin or the like which, of course, is relatively heavy and requires a time consuming manufacturing step. Thus, it would be desirable to obtain a plate-type heat exchanger which is compact, lightweight and which is economical in both manufacture and operation. It is even more desirable to obtain such a plate-type heat exchanger in the form of a continuous sheet exchanger rather than as a discrete plate exchanger for the reasons discussed above.

A plate-type heat exchanger of the discrete plate exchanger type is available under the name Temp-X-Changer from United Air Specialists, Inc. of Cincinnati, Ohio. This heat exchanger includes a plurality of separate adjacent corrugated plates which extend through a housing between opposed open ends thereof so that the end edges of each corrugated plate are within the region of the open housing ends, respectively. Each of the plates is slotted at the center of each end edge to define upper and lower edge portions for each end edge of each plate. The upper and lower portions of an end edge of each plate are sealed to the upper and lower edge portions of the adjacent end edges of the two adjacent plates, respectively, i.e., the plates to the immediate right and the immediate left of that plate. The upper and lower edge portions of the other end edge of that plate are similarly sealed, but to the upper and lower edge portions of the opposite, i.e., the left and right adjacent plates. This sealing technique results in alternate pairs of adjacent plates defining a first set of fluid flow channels for warm air while the other alternate pairs of adjacent plates define a second set of fluid flow channels for cool air.

Although this sealing technique is advantageous, the above-described conventional heat exchanger has the usual disadvantages inherent in discrete plate exchangers as described above. More particularly, this heat exchanger, like all discrete plate exchangers, requires the longitudinal edges of each plate to be secured to the housing structure and, additionally, these edges must be firmly sealed in place by a reinforced, thermosetting resin or a refractory cement bedding in order to form a rigid structure. Such sealing renders this heat exchanger relatively heavy while increasing the cost and time of manufacture. Further, such sealing does not always preclude the possibility of leakage between adjacent fluid flow passages whereby, for example, incoming cool air may become contaminated with outgoing stale air.

SUMMARY OF THE INVENTION

Accordingly, one object of the present invention is to provide a new and improved plate-type heat exchanger of the continuous sheet type.

Another object of the present invention is to provide a new and improved continuous sheet exchanger which is extremely economical in manufacture.

Still another object of the present invention is to provide a new and improved continuous sheet exchanger having a manifolding arrangement which requires a minimum of sealing and which requires only relatively lightweight and thin gauge material therefor.

A further object of the present invention is to provide a new and improved continuous sheet exchanger which is extremely compact, lightweight and durable.

Briefly, in accordance with the present invention, these and other objects are attained by providing a continuous sheet exchanger including a housing having first and second open ends and a thermal transfer core disposed within the housing which is formed of a continuous sheet of heat conductive material folded upon itself in opposite directions alternately to define a plurality of substantially parallel, mutually spaced sheet portions which extend through the housing, substantially each sheet portion thereby being located between first and second adjacent sheet portions. Each sheet portion has a pair of free edge sections located in the regions of the respective open ends of the housing. According to the invention, the upper and lower portions of one edge section of any particular sheet portion are sealed, such as by foil clips, to the respective upper and lower portions of the adjacent edge sections of the first and second adjacent sheet portions, respectively, while the upper and lower portions of the other edge section of that sheet portion are similarly sealed to the respective upper and lower portions of the adjacent edge sections of the opposite, i.e., the second and first adjacent sheet portions, respectively. By similarly sealing each sheet portion, a simple manifolding of the continuous sheet is accomplished whereby alternate pairs of adjacent sheet portions define a first set of fluid flow channels for warm air while the other alternate pairs of adjacent sheet portions define a second set of fluid flow channels for cool air.

By virtue of the structure of the present invention as described above, a continuous sheet plate-type exchanger is obtained having the usual high efficiency and low pressure drop which is characteristic of such continuous sheet exchangers while being more compact and lighter in weight than presently available plate-type heat exchangers. Of greatest significance is the reduced cost of manufacture of heat exchangers constructed according to the present invention as well as the reduced time required for such manufacture. Further, the present invention has significant advantages with respect to the Temp-X-Changer device described above in that there is no requirement for securing the thermal transfer core within the housing and, additionally, it is not necessary to embed the edges of the heat conductive material in thermosetting resin, refractory cement or the like. Consequently, there is no danger of cross-contamination between the warm and cool air flows.

Further, it is only necessary in the present invention to provide a simple seal structure around the periphery of the thermal transfer core at just one of the open housing ends and at the substantial mid-height of the sheet portion edge section in order to assure that no cross-leakage can occur between the channels of the first and second sets and separate the two air flows as the latter enter and exit the exchanger from a respective housing end. Such seal structure can advantageously be a cushion of silicone foam rubber.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
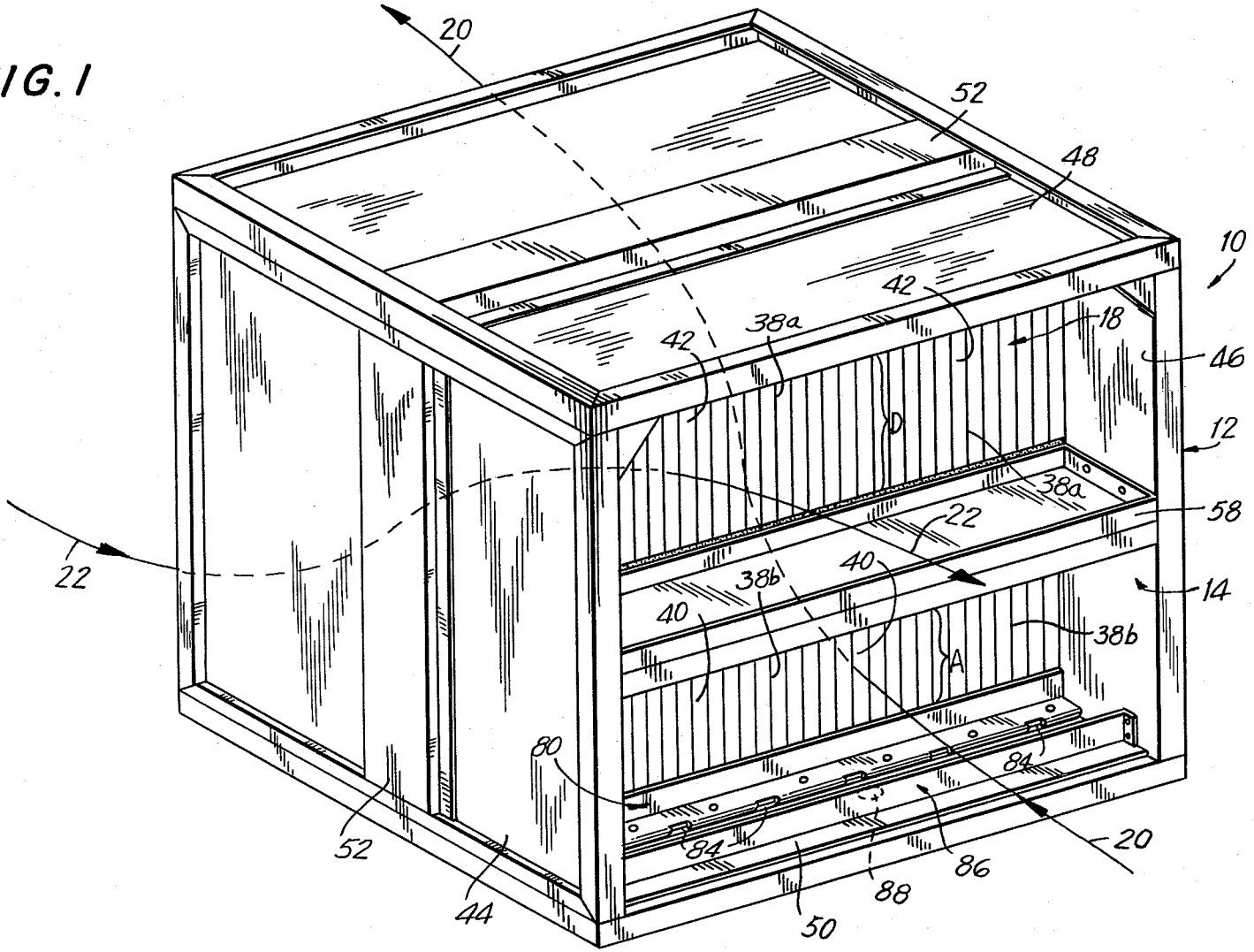
FIG. 1 is a perspective view of a continuous sheet exchanger according to the present invention showing one of the open ends of the housing through which a first air flow enters and from which a second air flow exits through respective fluid transmitting openings.
Figure 2:
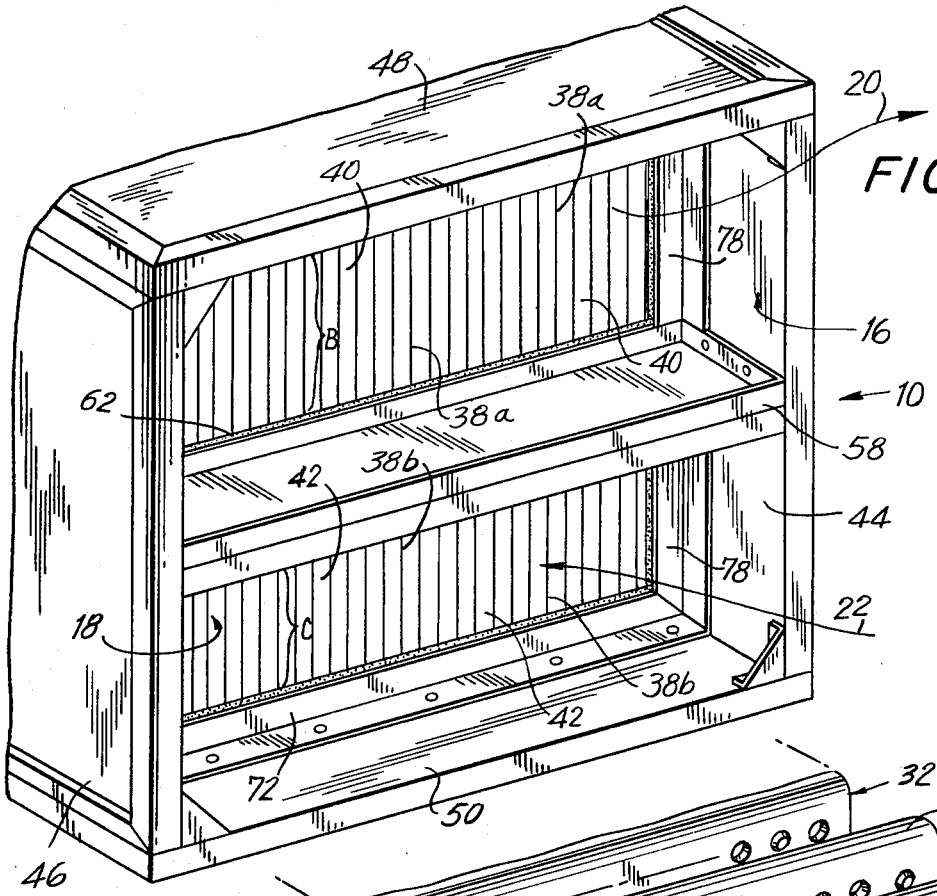
FIG. 2 is a fragmentary perspective view similar to that illustrated in FIG. 1 showing the other open end of the housing wherein the first air flow exits and the second air flow enters through respective fluid transmitting openings.
Figure 3:
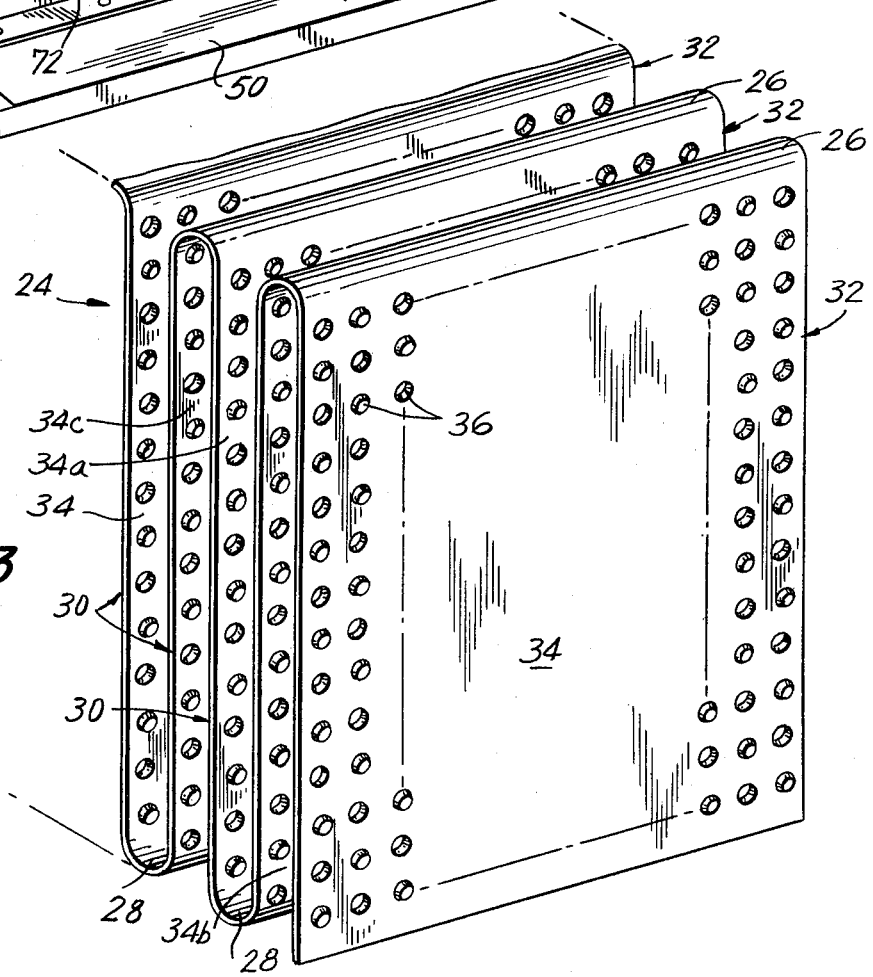
FIG. 3 is a fragmentary perspective view illustrating a preferred embodiment of a continuous sheet of heat conductive material utilized in the manufacture of the thermal transfer core which is incorporated in the heat exchanger of the present invention, illustrated in an intermediate manufacturing configuration.

Referring now to the drawings wherein like reference characters designate identical or corresponding parts throughout the several views and more particularly to FIG. 1–3, the continuous sheet exchanger of the present invention, generally designated 10, comprises a generally box-shaped housing 12 having first (FIG. 1) and second (FIG. 2) opposed open ends 14, 16 respectively, and a thermal transfer core 18 disposed within housing 12. The thermal transfer core is formed of a continuous sheet of heat conductive material which, according to the present invention as described in detail below, is manifolded in a manner such that two air flows, e.g., exhaust air flow 20 and make-up air flow 22 pass in counterflow relation through the exchanger 10 in an X-shaped pattern. More particularly, exhaust air flow 20 enters the heat exchanger 10 through a first fluid transmitting opening A at housing end 14 (FIG. 1) and exits from the heat exchanger through a second fluid transmitting opening B at housing end 16 (FIG. 2). On the other hand, the make-up air stream 22 enters the heat exchanger 10 through a third fluid transmitting opening C at housing end 16 (FIG. 2) and exits through a fourth fluid transmitting opening D at housing end 14 (FIG. 1). As explained in greater detail below, each respective air flow 20, 22 flows through a respective set of channels formed by adjacent sheet portions of the continuous sheet of heat conductive material, the channels of each set alternating with each other so that heat is transferred from the warmer to the cooler air flow through the heat conductive material.

Figure 7:
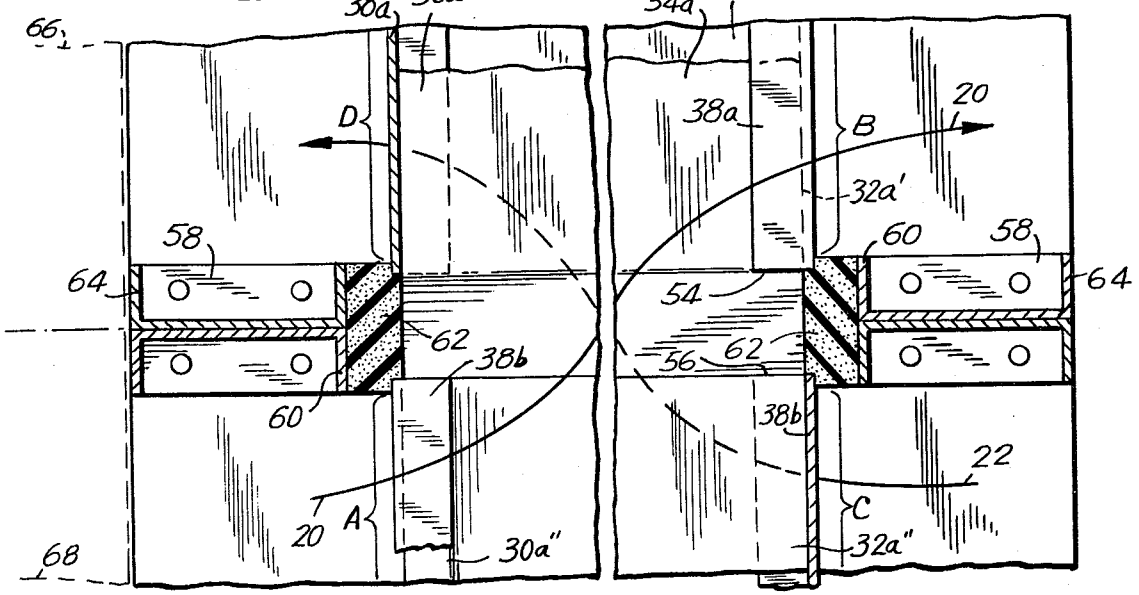
FIG. 7 is a section view taken along line 7—7 of FIG. 4.

Referring to FIG. 3, a continuous sheet 24 of heat conductive material utilized for the thermal transfer core 18 is illustrated during an intermediate manufacturing step. More particularly, the continuous sheet 24 comprises a thin sheet of heat conductive material such, for example as aluminum having a thickness of 0.01 inch. The sheet 24 is folded upon itself in opposite directions alternately along upper and lower fold regions 26, 28 which extend transversely between first and second longitudinally extending edges 30, 32. In this manner a plurality of substantially parallel sheet portions 34 are defined between the upper and lower fold regions 26, 28. Each sheet portion 34 terminates at first and second free edge sections 30, 32 so that, referring to FIGS. 3 and 7 for example, the sheet portion designated **34*a* has a first free edge section 30*a* and a second free edge section 32*a* (FIG. 7**).

In order to provide appropriate spacing between adjacent sheet portions 34, the continuous sheet 24 is formed with a multiplicity of raised and depressed dimples 36 which are appropriately provided so that upon folding the continuous sheet 24 each dimple 36 will be aligned with and abut against a corresponding dimple in an adjacent sheet portion so that the pairs of adjacent sheet portions will be properly spaced from each other. In this connection, reference is made to U.S. Pat. No. 4,043,388 which discloses a particularly advantageous arrangement for such dimples. The depth of draw of the dimples is equal to about one half the desired spacing between the adjacent sheet portions and in one embodiment, where the spacing between adjacent sheet portions, i.e., the width of the fluid flow passage defined between the adjacent sheet portions, is 0.2 inches, the depth of the dimples 36 is approximately 0.1 inches.

Referring now to FIGS. 4–8, the manifolding of the continuous sheet 24 will now be described. As noted above, each sheet portion 34 is located between two sheet portions which are adjacent to it. Thus, for example, referring to FIGS. 3–7, a sheet portion **34*a* is located between first and second sheet portions 34*b*, 34*c*, respectively. According to the invention, the upper and lower portions 30*a*′ and 30*a*″, respectively of the first free edge section 30*a* of sheet portion 34*a* are sealed to the upper and lower portions 30*b*′ and 30*c*″ of the first free edge sections 30*b* and 30*c* of respective adjacent sheet portions 34*b* and 34*c*. In the illustrated preferred embodiment, this is carried out by means of foil clips 38, each being folded over on itself to clamp the corresponding edge section portions to each other. Preferably, a sealant material is applied to the edge sections prior to affixing the foil sealing clips 38** thereto.

In a reverse fashion, the upper and lower portions **32*a*′ and 32*a*″ of the second edge section 32*a* of sheet portion 34*a* are sealed to the upper and lower portions 32*c*′ and 32*b*″ of the second edge sections 32*c* and 32*b* of sheet portions 34*c* and 34*b***, respectively.

This sealing arrangement is repeated for each of the sheet portions 34. By this construction, alternate pairs of adjacent sheet portions define a first set of fluid flow channels 40, each of which opens at its respective ends at first and second fluid transmitting openings A and B, and a second set of fluid flow channels 42, each of which opens at its respective ends at second and third fluid transmitting openings C and D. As seen in FIGS. 1 and 2, fluid transmitting openings A and D are located at the open end 14 of housing 12 while fluid transmitting openings B and C are located at the other open end 16 of housing 12.

Figure 5:
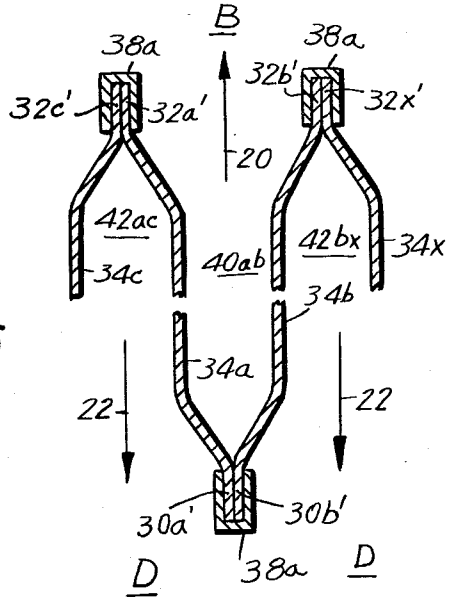
FIG. 5 is a section view taken along line 5—5 of FIG. 4.
Figure 6:
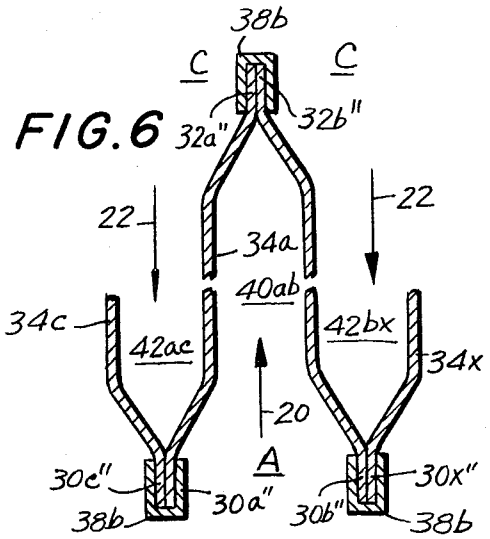
FIG. 6 is a section view taken along line 6—6 of the present invention, FIG. 6 being vertically aligned with respect to FIG. 5 in a corresponding manner.

For example, referring to FIGS. 4–7, the adjacent sheet portions **34*a* and 34*b* define between them a fluid flow channel 40*ab* through which the exhaust air flow 20 will enter through the first fluid transmitting opening A at the open end 14 of housing 12 and from which the flow will exit through the second fluid transmitting opening B at the open end 16 of housing 12. In this connection it is seen that the exhaust air stream 20 will enter into the fluid flow channel 40*ab* defined by sheet portions 34*a* and 34*b* at fluid transmitting opening A located in the lower region of housing end 14 since these sheet portions are sealed to each other along the upper portions 30*a*′ 30*b*′ (FIG. 5) of their first edge sections 30*a*, 30*b* as described above. The lower portions 30*a*″, 30*b*″ of the first edge sections 30*a*, 30*b* of sheet portions 34*a*, 34*b* are, however, spaced from each other at the fluid transmitting opening A since, according to the invention, these edge section portions are respectively sealed (FIG. 6) to the lower portions 30*c*″, 30*x*″ of sheet portions 34*c*, 34*x* which are outwardly adjacent to sheet portions 34*a*, 34*b*. The entry of air stream 20 is illustrated in FIGS. 6 and 7 wherein it is seen as entering the first fluid transmitting opening A in the lower region of housing end 14**.

Immediately upon entering the channel **40*ab* defined by sheet portions 34*a*, 34*b*, i.e., as soon as the air flow passes the sealed edge portions 30*a*″, 30*b*″, it expands so that it comes into heat transfer contact with substantially the entire surface area of the sheet portions 34*a*, 34*b*** thereby achieving maximum thermal transfer efficiency.

The air flow 20 directed through the fluid flow channel **40*ab* exits therefrom at fluid transmitting opening B located in the upper region of housing end 16. Sheet portions 34*a*, 34*b* are sealed to each other along the lower portions 32*a*″, 32*b*″ (FIG. 6) of their second edge sections 32*a*, 32*b* as described above. The upper portions 32*a*′, 32*b*′ of the second edge sections 32*a*, 32*b* of sheet portions 34*a*, 34*b* are however spaced from each other at the fluid transmitting opening B since, according to the invention, these edge section portions are respectively sealed (FIG. 6) to the upper portions 32*c*′**, 32x' of sheet portions 34c, 34x which are outwardly adjacent to sheet portions 34a, 34b. The exit of air flow 20 is illustrated in FIGS. 5 and 7 wherein it is seen as exiting from the second fluid transmitting opening B at the upper region of housing end 16.

It is apparent from the above that each of the fluid transmitting openings A, B of the first set of fluid flow channels 40 through which air flow 20 travels comprises the plurality of open ends of alternate pairs of adjacent sheet portions whose lower edge section portions are spaced at housing end 14 to define opening A and whose upper edge section portions are spaced at housing end 16 to define opening B.

Referring to FIG. 7, the direction of the air flow 20 is generally upwardly (in the drawing), i.e., it enters the exchanger through the lower opening A and exits therefrom through the upper opening B. However, it is understood that the air stream occupies substantially the entire channel as it flows through the same.

As noted above, a second set of channels 42 are defined by the other alternate pairs of adjacent sheet portions, these second channels 42 opening at the third fluid transmitting opening C located in the lower region of housing end 16 and at the fourth fluid transmitting opening D located in the upper region of housing end 14. Thus, each such channel 42 (e.g. channel 42ac formed by sheet portion 34a and 34c) in the second set is defined by a pair of adjacent sheet portions (e.g. 34a and 34c) whose second edge sections (32a, 32c) have lower portions (32a'', 32c'') which are spaced from each other by being sealed to the next respective outwardly adjacent sheet portions and whose upper portions (32a', 32c') are sealed together. The first edge sections (e.g. 30a, 30c) of these two sheet portions which define the channel (42ac) in the second set similarly have their lower portions (30a'', 30c'') sealed to each other and their upper portions (30a', 30c') spaced from each other. In this manner, a second set of channels 42 which alternate with the channels 40 of the first set is defined. An air flow 22 is directed in counterflow relationship through channels 42 to the air flow 20.

The fluid transmitting opening C, D of the second set of fluid flow channels 42 through which air flow 22 travels comprises the plurality of open ends of alternate pairs of adjacent sheet portions whose lower edge section portion are spaced at housing end 16 (to define opening C) and whose upper edge section portions are spaced at housing end 14 (to define opening D).

It is thus seen that this manifolding technique when utilized in a continuous sheet heat exchanger provides a thermal transfer core wherein two sets of alternating fluid flow channels are defined, each set of channels opening at respective spaced regions, e.g., upper and lower, at the two open ends of the exchanger housing. This structure is advantageous for the reason that it particularly lends itself to having the first and second sets of channels transmit first and second gas streams, e.g., a stream of exhaust and a stream of make-up air, which are admitted into the exchanger through the opposed open ends thereof. Also inherent in the operation of the thermal transfer core is the fact that the two gas streams are directed in crossing fashion, i.e., in a manner such that maximum travel over the intervening sheet portion will occur, the gas streams crossing in an "X" fashion as best seen in FIG. 7.

After having considered the above-described construction of the thermal transfer core 18 of the plate exchanger of the present invention, the assembly of the same in the housing 12 will now be described. Housing 12 is defined by a pair of opposed side walls 44, 46 and opposed top and bottom walls 48, 50. These housing walls are preferably formed of metallic sheet stock, such, for example, as steel or aluminum and are attached to each other at their respective mating edges by welding, threaded fasteners, rivets or the like. Reinforcing channels 52 are preferably provided on the housing walls as illustrated in FIG. 1. Prior to completing the construction of the housing 12, the thermal transfer core 18 is located in the interior thereof. More particularly, the thermal transfer core comprising the continuous sheet 24 which has been manifolded in the manner described above is located within the housing such that the upper and lower fold regions 26, 28 are located contiguous with the top and bottom walls 48, 50 of the housing respectively so that they extend longitudinally therein in a manner such that the first and second edge sections of the sheet portions are located substantially at the first and second open ends 14, 16 of housing 12. After the thermal transfer core 18 is located as described above, the construction of the housing 12 is completed.

The utilization of the above-described manifolding technique results in one of the upper and lower portions of either the first and second edge sections of each of the endmost sheet portions, i.e., the sheet portions directly adjacent to the housing side walls, 44, 46, not being sealed to any adjacent edge section portions. For example, in one particular orientation of the heat exchanger, the upper portions of the first edge sections of the endmost sheet portions may remain unsealed after manifolding. These free edge section portions are sealed to the housing preferably by sealing them to the housing side walls using a silicone sealant and bolts or the like and, preferably, by clamping the upper regions of the same between the mating surfaces of the housing top wall 48 and the two side walls 44, 46 respectively.

As mentioned above, by virtue of the manifolding arrangement of the continuous sheet of heat conductive material, two separate sets of alternating fluid flow channels are defined in the thermal transfer core. The channels of each such set of channels are fluidly isolated from the channels of the other set and this is accomplished as described above without the need for securing the upper and lower fold regions of the continuous sheet to the housing and, further, without necessity of embedding the thermal transfer core in a thermosetting resin or the like. This feature provides a significant advantage relative to prior art plate-type heat exchangers of the Temp-X-Changer type described above in that a costly and time consuming manufacturing step is not required. Further, since it is not necessary to embed the thermal transfer core, the total weight of the heat exchanger will be significantly reduced as will its bulk.

Figure 4:
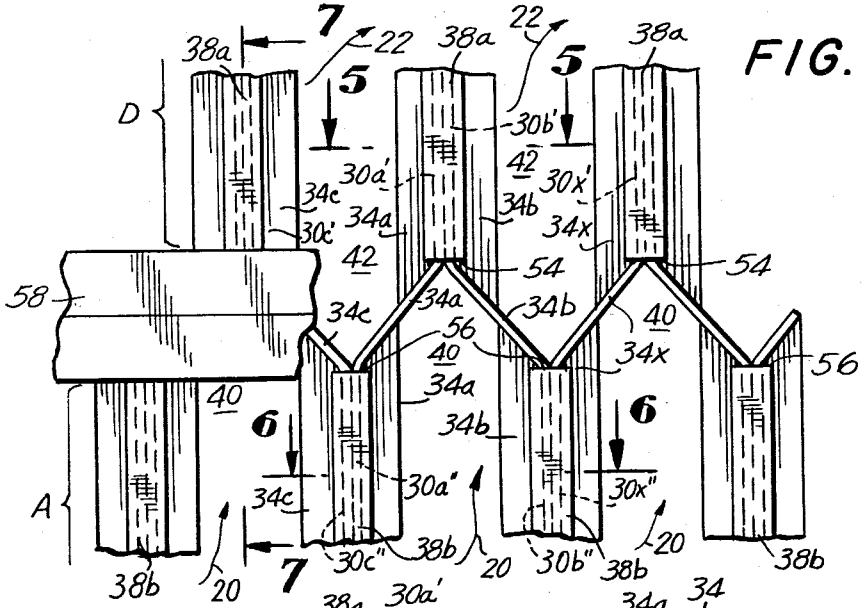
FIG. 4 is a front view partially broken away of the central portion of one edge region of the thermal transfer core illustrating the sealing arrangement utilized in the present invention.
Figure 8:
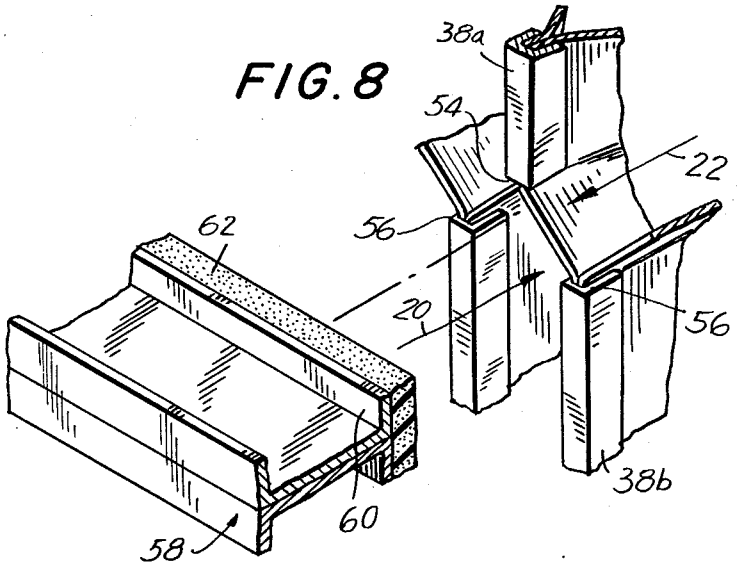
FIG. 8 is a fragmentary exploded perspective view illustrating a preferred sealing arrangement utilized in the present invention.
Figure 11:
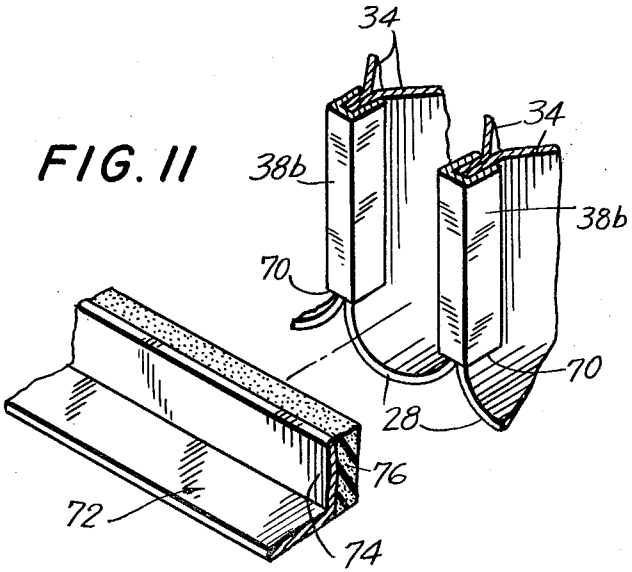
FIG. 11 is an exploded, fragmentary perspective view illustrating the sealing of the thermal transfer core in the peripheral regions thereof at one end of the housing.

However, in order to prevent cross-contamination of the respective fluid flows in the regions of the open ends 14, 16 of housing 12 it is necessary to provide certain sealing means in addition to the particular manifolding structure described above, namely the foil clip sealing of adjacent portions of adjacent edge sections. More particularly, referring to FIGS. 1, 2, 4 and 8, the centrally facing opposed ends 54, 56 of the upper and lower foil clips (designated 38a, 38b, respectively) must of necessity be located vertically spaced from each other in order to allow each edge section of a particular sheet portion to become vertically realigned so that its upper and lower portions can be sealed to the respective adjacent edge section portions of the adjacent sheet portions. Thus a zig-zag pattern of the central portions, i.e., the portions of the edge sections between the opposed foil clip ends 54, 56 which are not clamped by a foil clip, of adjacent edge sections is defined as seen in FIGS. 4 and 8. In order to prevent cross-contamination between adjacent first and second channels 40, 42 at the region of the first and second ends of the housing, a central sealing means is provided for fluidly sealing or isolating the adjacent first and second channels from each other in the region between the centrally facing ends 54, 56 of the upper and lower foil strips 38*a*, 38*b*. In the preferred embodiment, the sealing means takes the form of an I-beam member 58 formed by a pair of channel members mutually connected at their webs and having an inwardly facing flange 60 to which is applied a layer 62 of sealing material, such as silicone foam rubber. The height of the flange 60 and sealing layer 62 is greater than the vertical distance between the centrally facing opposed ends 54, 56 of the sealing strips 38*a*, 38*b*, so that upon the I-beam being located against the central portions of the adjacent edge sections, the sealing layer 62 will sealingly engage the innermost regions of the centrally facing ends of the respective foil strips as seen in FIG. 7. The beam 58 is provided with end flanges which are fastened to the side walls 44, 46 in the location described above by conventional means, such as rivets as seen in FIGS. 1 and 2 whereby the sealing layer 62 sealingly engages the free central portions of the sheet portion edge sections. As seen in FIG. 7, identical structure is provided at both open ends 14, 16 of the housing 12. In this manner, any possibility of cross-contamination between adjacent fluid flow channels 40, 42 at the central regions of housing ends 14, 16 is eliminated. Of course, one of the central sealing means defines the boundary between the first and fourth fluid transmitting openings A, D at the first open end 14 of housing 12 while the other of the central sealing means defines the boundary between the second and third fluid transmitting openings B, C at the second open end 16 of housing 12. The provision of the central sealing structure also facilitates the connection of air ducts to the respective fluid transmitting openings when desired. Thus, for example, an air duct, designated 66 in FIG. 7, can be fastened to the flanges of the housing walls and to the outer flange 64 of I-beam 58 and fluid transmitting opening D. Similarly, another air duct 68 can be similarly provided in fluid communication with opening A as well as the remaining openings.

The particular illustrated embodiment of the central sealing means is advantageous in other respects. Thus, in the above-described Temp-X-Changer device, as noted above, each of the individual plates forming the thermal transfer core must be slotted at their centers to effect the manifolding. In order to prevent cross-contamination at the slotted centers, it is necessary to provide a sealing member comprising a plate which is inserted between the respective slots. Not only is this sealing technique not as efficient as the technique utilized in connection with the present invention but, additionally, extra manufacturing steps are required to even form the slots in the first place.

Referring now to FIGS. 2 and 9–11, utilization of the above-described manifolding technique also results in the foil clips 38 at one of the housing ends, i.e., end 16, necessarily terminating at their outwardly facing ends 70 at a point somewhat vertically spaced from the fold regions of the continuous sheet 24. Thus, referring to FIGS. 9–11 which illustrate the lower region of the fluid transmitting opening C at housing end 16, it is seen that the outer ends 70 of the respective foil strips 38*b* are located vertically spaced from the lower fold regions 28 which interconnect adjacent sheet portions 34. This is inherent in the structure of the device since in general the adjacent pairs of portions of either the first or second edge sections which are mutually sealed to each other by the foil clips 38 at one housing end are integral with respective adjacent pairs of fold regions 26, 28 so that a pair of U-shaped portions of the edge sections corresponding to the fold regions integral with the sealed edge section remain free or unclipped. It is understood however that at the other end of the housing ends, e.g., housing end 14 (FIGS. 12 and 13), the adjacent pairs of the edge section portions which are sealed to each other by clips 38 extend from the same fold region and the clip which seals the adjacent edge section portions to each other extends to the extremity of the edge section portion crimping the fold region within.

Figure 9:
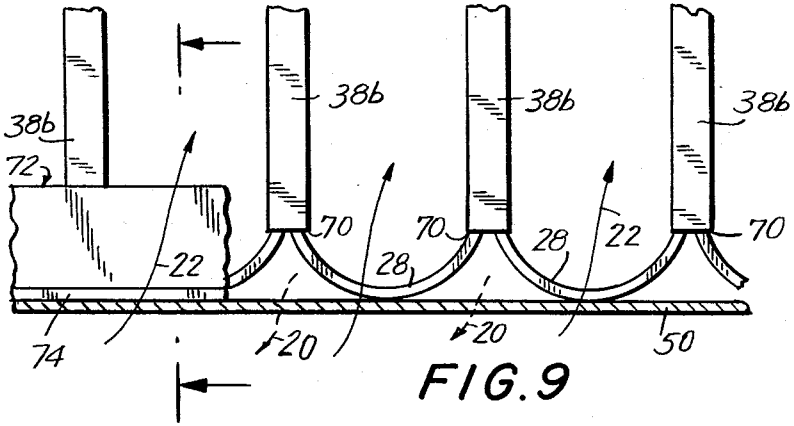
FIG. 9 is a front view, partially broken away, of a portion of the periphery of one end of the heat exchanger according to the present invention illustrating the sealing in this portion.
Figure 10:
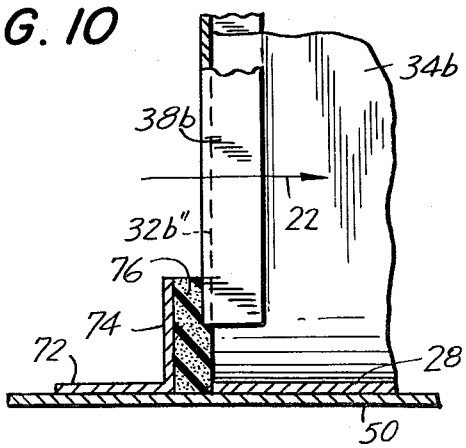
FIG. 10 is a section view taken along line 10—10 of FIG. 9.

Considering the structure of the thermal transfer core at the housing end 16 as shown in FIG. 9, the fluid flow channels 42 comprise channels of the second set into which the air stream 22 enters. However, as also illustrated schematically in FIG. 9, the other air flow 20 which is directed in a counterflow relationship to air flow 22 is being directed through fluid flow channels defined by adjacent sheet portions whose lower edge portions are sealed by foil clips 38*b*. Due to the fact that these foil clips must terminate at their outer ends 70 above the fold regions 28, absent the structure described below, it is possible for the air flow 20 to exit from this lower region as indicated by the dashed arrow and to possibly cross-contaminate with the air flow 22. It is also understood that similar structure is present in the upper peripheral edge region of the fluid transmitting opening B at housing end 16.

The present invention permits a simple and expedient manner of insuring against the possible cross-contamination of the air flow at the one housing end, e.g. housing end 16 in the above-described embodiment. More particularly, peripheral sealing apparatus are provided at the top and bottom walls 48, 50 of housing 12, i.e., at the upper and lower regions of fluid transmitting openings B, C, respectively. Each such peripheral sealing means comprises an angle member 72 one of whose flanges 74 has a layer of sealing material 76 such, for example, as silicone foam rubber, affixed thereto. The flange 74 and associated layer of sealing material 76 have appropriate dimensions such that upon being located adjacent to the respective one of the peripheral regions of the fluid transmitting openings B, C, the exposed surface of the sealing layer will sealingly engage the outer end of the foil clips 38 as well as the free portions of the edge sections of the respective sheet portions i.e., the fold regions. In this manner, any cross-contamination between the respective air streams 20, 22 is prevented. The angle member 72 is advantageously affixed in the above manner by fixing the other flange of the angle member to the respective top or bottom wall of the housing by conventional means, such as by welding, riveting or the like.

Further, referring to FIG. 2, similar sealing members are provided along the side peripheral regions of the fluid transmitting opening 16, designated 78. Such sealing further prevents any cross-contamination from occurring at the side regions of the fluid transmitting opening 16.

As noted above, such peripheral sealing structure is required at only one of the open ends of the heat exchanger constructed according to the present invention. Thus, in the illustrated embodiment, the sealing arrangement 72, 78 are required only at the second housing end 16 and, as seen in FIG. 1, no such sealing arrangements are required at the other fluid-transmitting opening 14. The reason for this will be appreciated when it is recognized that once any cross-examination is prevented at the peripheral edge regions at one of the fluid-transmitting openings, it is impossible for such cross-contamination to occur at the other fluid-transmitting opening. Thus, it is not necessary to provide any sealing at the other fluid transmitting opening.

Figures 12, 13:
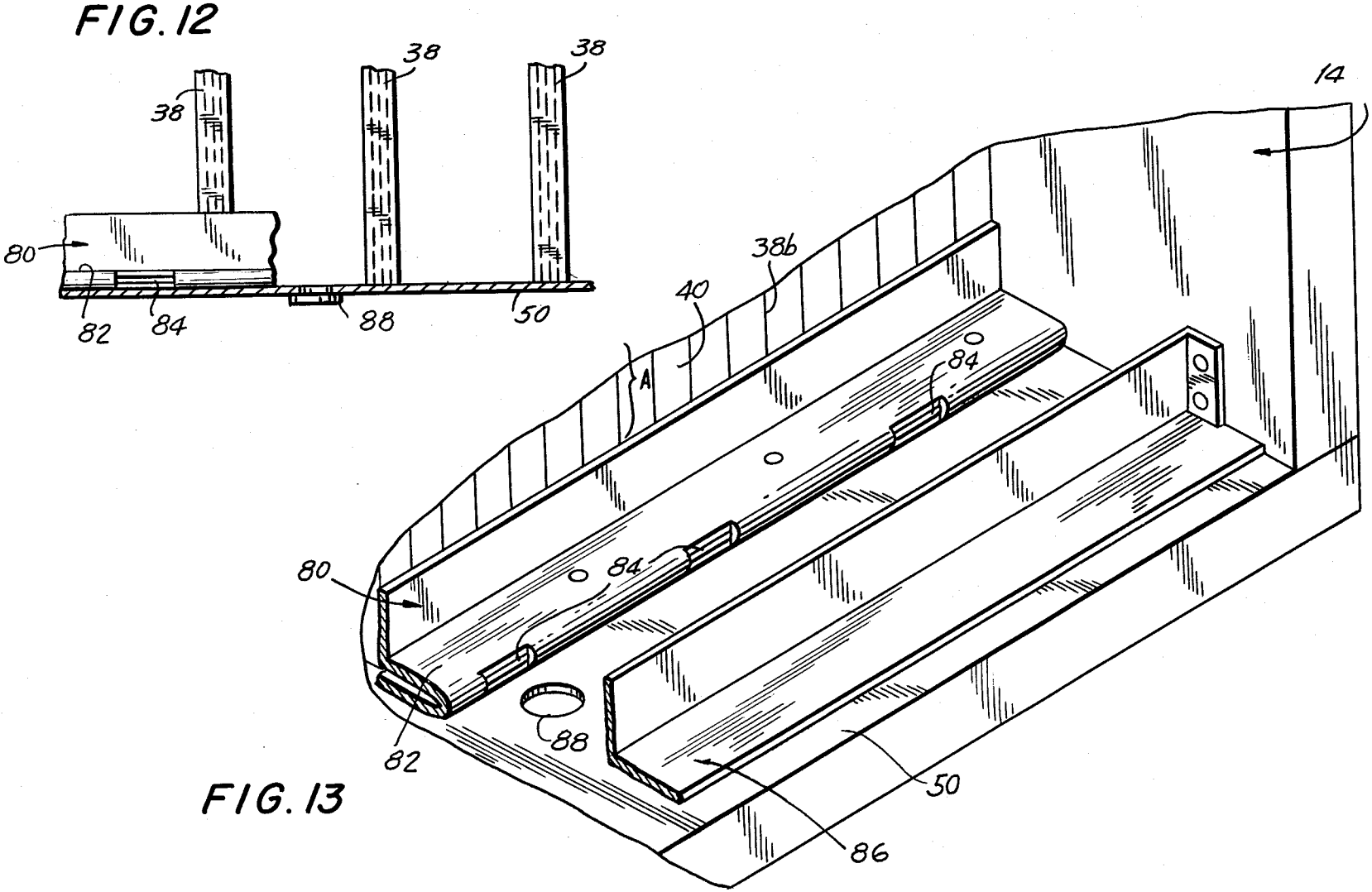
FIG. 12 is a partial front view of the other open end of the heat exchanger housing illustrating that the foil clips perform the entire sealing function on this end.
FIG. 13 is an exploded, fragmentary perspective view of the same end shown in FIG. 12 illustrating the condensate drain feature of the present invention.

Referring now to FIGS. 12 and 13, the structure of the heat exchanger at the lower region of opening A at the other end 14 of the housing is illustrated. As mentioned above, it is not necessary to provide any peripheral sealing apparatus at this end. However, angles 80 are fixed to the top and bottom walls 48, 50 of the housing 12 in order to provide both a support and protection function.

Further, since condensate is necessarily formed in the fluid flow channels during operation of the heat exchanger, it is desirable to provide means by which the condensate can be drained. To this end, the lower support angle 80 illustrated in FIG. 13 has a flange 82 which is formed by bending the sheet material over itself and in which a series of spaced slots 84 are formed through which any condensate formed can pass. A sealing dam 86 is fixed to the bottom wall 50 of housing 12 spaced forwardly from support angle 80 so that the condensate which passes through the slots 84 will be confined in the space between the angle 80 and dam 86. A condensate drain port 88 is formed in the housing bottom wall 50 within this space so that the accumulated condensate can be drained.

From the above, it is seen that the present invention provides a plate-type heat exchanger wherein the manifolding is of an extremely simple construction and yet which results in the significant advantage in that only a minimum of sealing is required. In this connection, the use of any thermosetting resin or the like is not required and, therefore, the heat exchanger of the present invention can be formed of relatively lightweight and thin gauge material. This, of course, results in the compactness, lightness and economy which is not found in conventional plate-type exchangers.

Obviously, numerous modifications and variations of the present invention are possible in the light of the above teachings. It is therefore to be understood that within the scope of the appended claims, the invention may be practiced otherwise than is specifically disclosed therein.

What is claimed is:

1. A heat exchanger for transmitting thermal energy from one moving body of fluid to another, comprising:

a housing defined by a pair of opposed side walls and opposed top and bottom walls and having first and second open ends; and a thermal transfer core disposed within said housing including, a continuous sheet of heat conductive material having first and second longitudinally extending edges, said sheet being folded upon itself in opposite directions alternately on fold regions which extend between said first and second ends of the housing and transversely to said longitudinally extending edges to define between said fold regions a plurality of substantially parallel, mutually spaced sheet protions, each sheet portion extending through said housing and having first and second terminal edge sections located in the regions of said first and second open ends, respectively, and wherein said fold regions comprise an upper set of fold regions located contiguous with said top housing wall and a lower set of fold regions located contiguous with said bottom housing wall, and, wherein for substantially each sheet portion which is located between first and second sheet portions which are adjacent thereto, edge sealing means are provided for sealing upper and lower portions of the first edge section thereof to upper and lower portions of the respective first edge sections of said first and second adjacent sheet portions respectively, and for sealing upper and lower portions of the second edge section thereof to upper and lower portions of the respective second edge sections of said second and first adjacent sheet portions respectively, whereby alternate pairs of adjacent sheet portions define first channels for flow of fluid moving through the exchanger and wherein the other alternate pairs of adjacent sheet portions define second channels for flow of fluid moving through the heat exchanger.

2. Apparatus as recited in claim 1 wherein said edge sealing means comprise a plurality of foil clips, each foil clip fluidly sealing an adjacent pair of upper and lower edge section portions to each other.

3. Apparatus as recited in claim 1 wherein each of said sheet portion edge sections has a free, unsealed central portion.

4. Apparatus as recited in claim 3 further including central sealing means overlying said free, unsealed central edge section portions for fluidly sealing adjacent first and second fluid channels with respect to each other.

5. Apparatus as recited in claim 4 wherein said central sealing means comprises first and second rectilinear sealing members formed of a sealing material, said first and second sealing members extending transversely over said first and second edge sections respectively and sealingly engaging the free, unsealed central edge section portions.

6. Apparatus as recited in claim 5 wherein said sealing material is silicone foam rubber or the like.

7. Apparatus as recited in claim 1 wherein at only one of said housing ends, the edge section portions of a pair of mutually sealed edge section portions are integral with a respective pair of fold regions and wherein said pairs of upper and lower mutually sealed edge section portions terminate at a point spaced inwardly from the respective integral fold regions to define substantially U-shaped free peripheral edge section portions.

8. Apparatus as recited in claim 7 further including peripheral sealing means overlying said free peripheral edge section portions at said only one housing end and for fluidly sealing adjacent first and second fluid channels with respect to each other.

9. Apparatus as recited in claim 8 wherein said peripheral sealing means comprises a pair of rectilinear peripheral sealing members formed of a sealing material, said rectilinear peripheral sealing members sealingly engaging said free peripheral edge section portions.

10. Apparatus as recited in claim 9 wherein said sealing material is silicone foam rubber or the like.

11. Apparatus as recited in claim 1 wherein each of the two endmost sheet portions which are directly adjacent to said housing side walls, respectively, has a free edge section portion which is not sealed to an adjacent edge section portion, said free edge section portion being sealed to the respective housing side walls.

12. Apparatus as recited in claim 11 wherein a region of each of said free edge section portions is clamped between one of the top and bottom housing walls and a respective side wall.

13. Apparatus as recited in claim 1 further including means for draining any condensate formed in said fluid flow channels from said heat exchanger housing.

14. Apparatus as recited in claim 13 wherein at only one of said housing ends, the edge section portions of a pair of mutually sealed edge section portions are integral with a single fold region and further including means for accumulating condensate which exits from said fluid flow channels at said only one of said housing ends and a drain port located in said accumulating means through which the accumulated condensate can be withdrawn.

15. Apparatus as recited in claim 14 wherein said condensate accumulating means comprises a rectilinear member having slots formed therein extending transversely adjacent to the periphery of only one housing end and a second rectilinear member spaced forwardly therefrom.

* * * * *